US006971918B1

(12) United States Patent
Su et al.

(10) Patent No.: US 6,971,918 B1
(45) Date of Patent: Dec. 6, 2005

(54) CARD CONNECTOR

(75) Inventors: Chia Sheng Su, Tucheng (TW); Ming Chun Lai, Tucheng (TW)

(73) Assignee: Cheng Uei Precision Industry Co., Ltd., Taipei (TW)

( * ) Notice: Subject to any disclaimer, the term of this patent is extended or adjusted under 35 U.S.C. 154(b) by 0 days.

(21) Appl. No.: 11/030,141

(22) Filed: Jan. 7, 2005

(51) Int. Cl.[7] ..... H01R 24/00
(52) U.S. Cl. ..... 439/630; 439/945; 361/737
(58) Field of Search ..... 439/79–83, 59, 439/159, 630–631, 541.5, 637, 945–946; 361/737; 235/492

(56) References Cited

U.S. PATENT DOCUMENTS 6,607,405 B2 * 8/2003 Nishimura ..... 439/630
6,716,066 B1 * 4/2004 Kuo ..... 439/630
6,773,308 B2 * 8/2004 Lwee ..... 439/630
6,821,155 B2 * 11/2004 Hsieh ..... 439/630
6,857,907 B1 * 2/2005 Hung et al. ..... 439/630
6,902,435 B1 * 6/2005 Cheng ..... 439/630
2001/0049232 A1 * 12/2001 Takei et al. ..... 439/630
2005/0020138 A1 * 1/2005 Takahashi et al. ..... 439/630
2005/0130498 A1 * 6/2005 Fan ..... 439/630

* cited by examiner

*Primary Examiner*—Michael C. Zarroli
(74) *Attorney, Agent, or Firm*—Rosenberg, Klein & Lee

(57) ABSTRACT

A card connector comprises an insulation member, a back row of spaced first contact terminals, a front row of spaced first contact terminals, a row of spaced second contact terminals and a shielding cover. The insulation member has a first receiving space for receiving a first electronic card and a second receiving space for receiving a second electronic card. Contacting portions of the back row and the front row of the first contact terminals extend into the first receiving space and are aligned and flush with each other. Contacting portions of the second contact terminals extend into the second receiving space. Soldering portions of the first and the second contact terminals all extend outwardly from the rear of the card connector. Therefore, the first and the second contact terminals can be easily soldered on a printed circuit board and entirely contact with contact pads of the electronic cards.

9 Claims, 4 Drawing Sheets

CARD CONNECTOR

BACKGROUND OF THE INVENTION

1. Field of the Invention

The present invention relates generally to a card connector, and in particular to an electronic card connector capable of receiving two types of electronic cards simultaneously.

2. The Related Art

Traditionally, a card connector that can only receive one exclusive type of electronic card can meet needs as tradition electronic appliance only need to mount one card. However, with the development of the electronic technology, nowadays, electronic appliances are required to expand functions by mounting variety types of electronic cards, for example, a SIM (Subscriber Identity Module) card, an SD (Secure Digital) card, a CF (Compact Flash) card, etc. Thus corresponding types of card connectors must be mounted in the electronic appliance to receive the cards. Those Connectors occupy large space of the electronic appliance, which cause the electronic appliance bulky. Therefore, the card connector is strongly required to be designed to receive two or more different electronic cards simultaneously.

U.S. Pat. No. 6,607,405 discloses a card connector for simultaneously receiving two different types of cards. The card connector has an upper slot for receiving a first card and a lower slot for receiving a second card. A plurality of first contact terminals are arranged in a row to contact with the first card, and a plurality of second contact terminals are arranged in two rows to contact with the second card. Solder portions of the first contact terminals extend out from the rear of the card connector. Solder portions of a part of the second contact terminals are disposed at the same rear side of the card connector, while solder portions of the rest of the second contact terminals are disposed at a front side of the card connector.

As described above, the soldered portions of the second contact terminals extend out in two opposite directions, so it is inconvenience to solder the second contact terminals. Additionally, contact portions of one row of the second contact terminals are not aligned with contact portions of the other row of the second terminals. The contact portions of the second contact terminals cannot be easily aligned and entirely contact with contact pads of the second card, as the contact pads of the second card are aligned front and rear.

SUMMARY OF THE INVENTION

Thus, an object of the present invention is to provide a card connector being capable of receiving two different types of electronic cards, with contact terminals being arranged for facilitating being soldered on a printed circuit board and entirely contacting with contact pads of the electronic cards to achieve exact electrical contact therebetween.

To achieve the above-mentioned object, the present invention provides a card connector comprising an insulation member, a back row and a front row of spaced first contact terminals and a row of spaced second contact terminals received in the insulation member, and a shielding cover for covering the insulation member. A protruding member is disposed in the insulation member and divides the insulation member into a first receiving space for receiving a first electronic card and a second receiving space for receiving a second electronic card. Each of the back row of the first contact terminals comprises a rear contacting portion extending into the first receiving space to electrically contact with the first electronic card, a rear connecting portion, and a rear soldering portion extending outwardly from a rear of the insulation member. Each of the front row of the first contact terminals comprises a front contacting portion, a bent portion, a front connecting portion and a front soldering portion. The front contacting portion extends into the first receiving space to contact with the first electronic card and is aligned and flush with the rear contacting portion. The bent portion connects the front contacting portion and the front connecting portion and offsets the front connecting portion a predetermined distance from the front contacting portion. The front connecting portion connects the bent portion and the front soldering portion. The front soldering portion extends outwardly from the same rear of the insulation member. Each spaced second contact terminal comprises a contacting portion extending into the second receiving space to electrically contact with the second electronic card, a connecting portion and a soldering portion extending outwardly from the same rear of the insulation member.

As described above, the soldering portions of the back row and the front row of the first contact terminals and the second contact terminals all extend outwardly from the rear of the insulation member for facilitating being soldered onto a printed circuit board. Furthermore, the rear contacting portions of the back row of the first contact terminals are aligned with the front contacting portions of the front row of the first contact terminals, so the contacting portions can be easily aligned and entirely contact with contact pads of the electronic card to ensure an electrical contact there-between.

The above and other objects, features and advantages of the present invention will become more apparent from the following description of an embodiment thereof taken in conjunction with the accompanying drawings.

DETAILED DESCRIPTION OF THE PREFERRED EMBODIMENT

Figure 1:
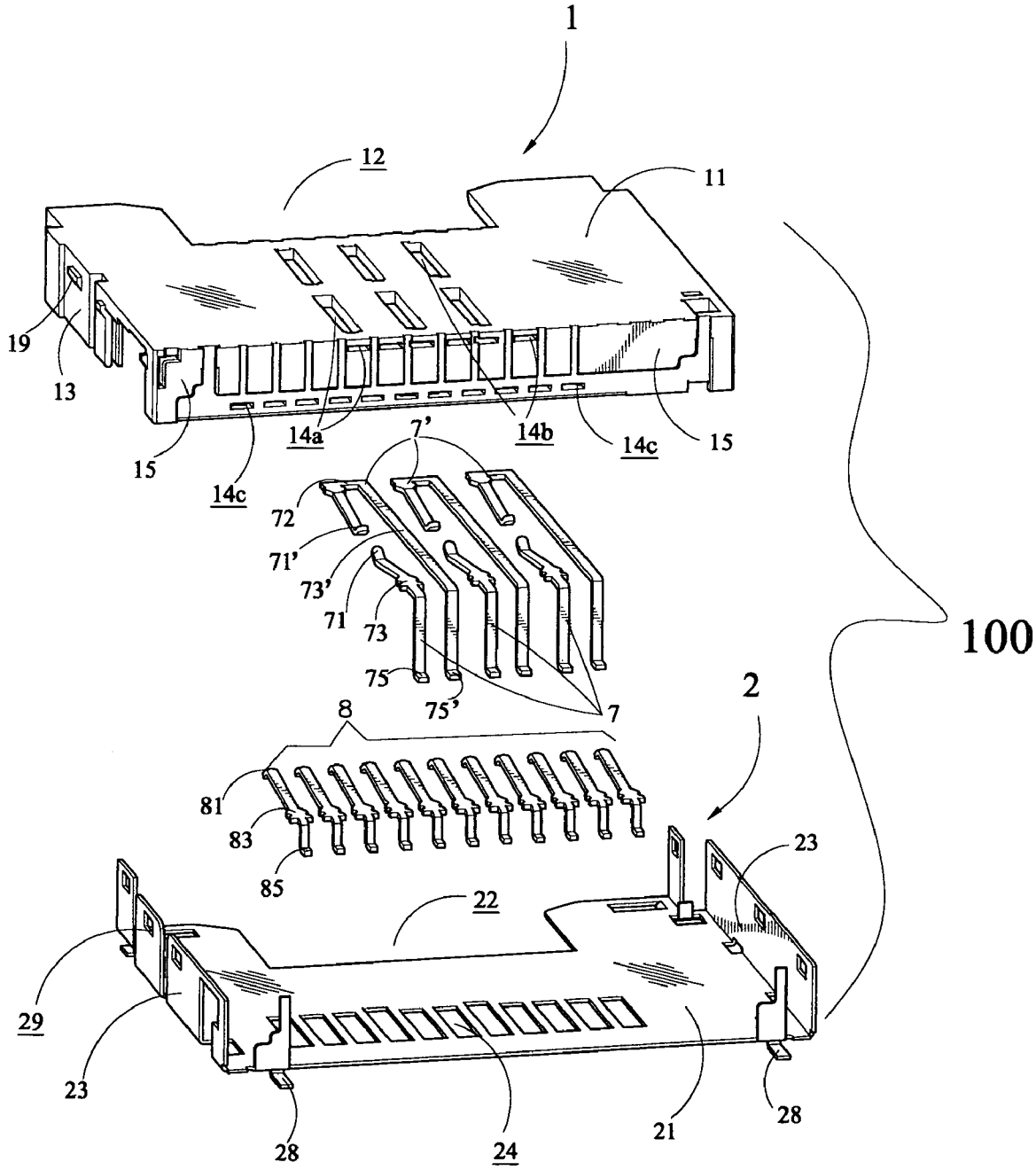
FIG. 1 is an exploded view of a card connector according to the present invention.
Figure 2:
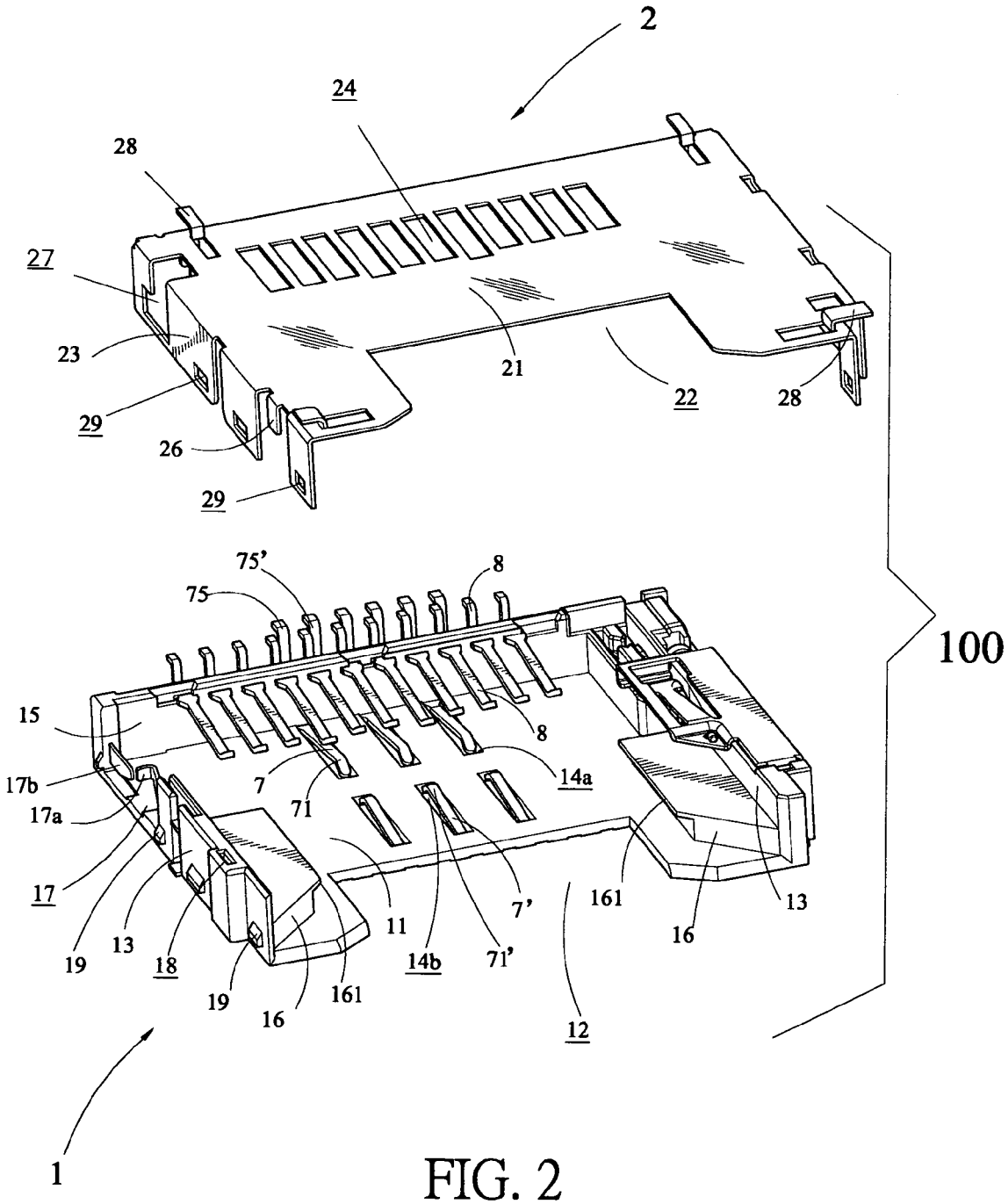
FIG. 2 is another exploded view of the card connector.

Referring to FIG. 1 and FIG. 2, a card connector 100 according to the present invention, comprises an insulation member 1, two rows of spaced first contact terminals 7 and 7', a row of spaced second contact terminals 8 and a shielding cover 2.

The shielding cover 2 has a baseboard 21, and two lateral boards 23 extending upwardly from opposite sides of the baseboard 21. A second U-shaped indentation is stampingly formed in the front end of the baseboard 21, and a plurality of holes 24 is defined in the rear portion of the baseboard 21. Four soldering slices 28 are stampingly and formingly formed at four corners of the baseboard 21 for being soldered onto a printed circuit board (not shown). Additionally, a plurality of latching cavities 29 and mounting piece 26 are disposed on the lateral boards 23 for securing the shielding cover 2 to the insulation member 1. A cutout 27 is defined in the rear portion of a lateral boards 23.

Figure 4:
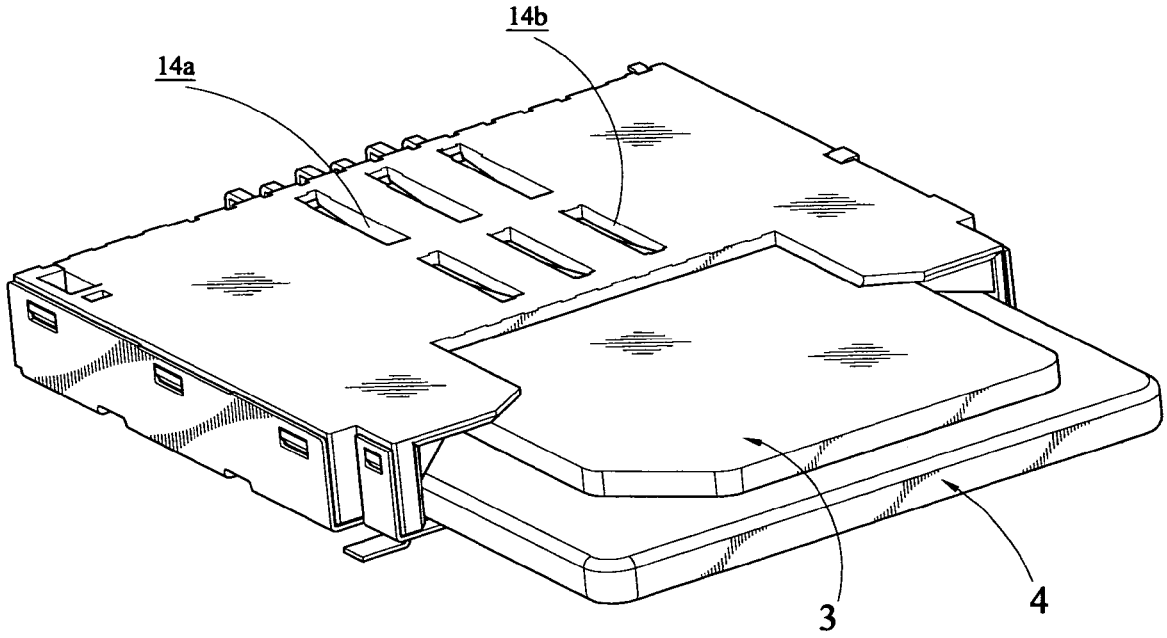
FIG. 4 is a perspective view of the card connector with two different types of electronic cards being received therein.

The insulation member 1 comprises a top wall 11, two lateral walls 13 and a rear wall 15 extending downwardly from two lateral sides and a rear side of the top wall 11. A first U-shaped indentation 12 is defined in the front end of the top wall 11 and aligns with the second U-shaped indentation 22 to form a space for conveniently inserting and withdrawing cards. A plurality of first terminal passages 14*a* and 14*b* are defined in the top wall 11 and arranged in a back row and a front row. The back row of the first terminal passages 14*a* and the front row of the first terminal passages 14*b* run through the rear wall 15 in a row. A plurality of second terminal passages 14*c* is defined in the rear wall 15 and arranged in a row under the first terminal passages 14*a* and 14*b*. A pair of platform members 16 is formed in inner corners between the top wall 11 and the lateral walls 13. The platform members 16 and the top wall 11 define a first receiving space, while the platform members 16 and the lateral walls 13 define a second receiving space. The first receiving space receives a first electronic card 3, and the second receiving space receives a second electronic card 4, as shown in FIG. 4. According to the present preferred embodiment, the first electronic card 3 is a SIM card, and the second electronic card 4 is a Mini SD card. Bottom edges of the two platform members 16 extend inwardly to form brims 161 respectively. When the first electronic card 3 inserted into the first receiving space, the first electronic card 3 is positioned between the platform members 16 and retained by the brims 161. A plurality of protrusions 19 is disposed on the lateral walls 13 to engage with the latching cavities 29 of the shielding cover 2. A plurality of mounting cavities 18 is defined in the lateral walls 13 to mate with the mounting piece 26 of the shielding cover 26. Additionally, a receiving room 17 is defined in the rear portion of the lateral walls 13 communicating with the cutout 27 of the shielding cover 2.

Figure 3:
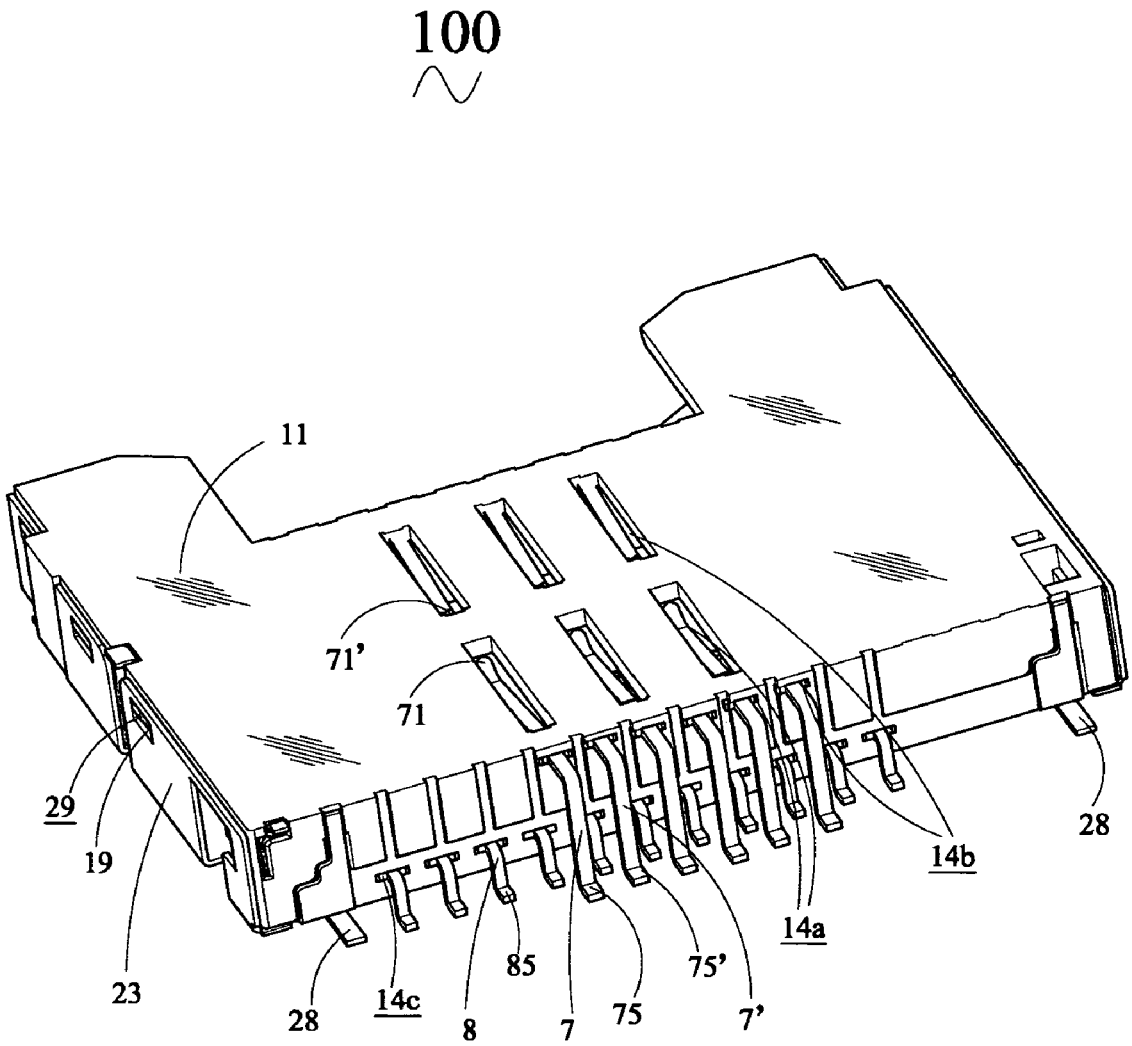
FIG. 3 is an assembly, perspective view of the card connector as shown in FIG. 1.

Referring to FIG. 1 and FIG. 3, the spaced first contact terminals 7 and 7' are arranged in two rows, namely a back row and a front row. Each of the back row of the first contact terminals 7 comprises a rear contacting portion 71, a rear soldering portion 75 and a rear connecting portion connecting the rear contacting portion 71 and the rear soldering portion 75. The rear contacting portions 71 are inserted into the back row of the first terminal passages 14*a* and extend into the first receiving space for electrically contacting with the first electronic card 3. The rear soldering portions 75 extend out of the rear wall 15 and bent downward to be soldered onto the printed circuit board (not shown). Each of the front row of the first contact terminals 7' comprises a front contacting portion 71', a bent portion 72, a front connecting portion 73' and a front soldering portion 75'. The front contacting portions 71' are inserted into the front row of the first terminal passages 14*b* and further extend into the first receiving space for electrically contacting with the first electronic card 3. The bent portions 72 connect the front contacting portions 71' and the front connecting portions 73' and offset the front connecting portions 73' a predetermined distance from the front contacting portions 71'. Therefore, the front contacting portions 71' can be aligned with and flush with the rear contacting portions 71, and the front connecting portions 73' can be parallel with the rear connecting portions 73. The front connecting portions 73' extend out of the rear wall 15 through the front row of the first terminal passages 14*b* and bent downward to form the front soldering portions 75' to be soldered onto the printed circuit board (not shown). The spaced second contact terminals 8 are arranged in a row. Each second contact terminal 8 comprises a contacting portion 81, a soldering portion 85 and a connecting portion 82 connecting the contacting portion 81 and the soldering portion 85. The second contact terminals 8 are inserted into the second terminal passages 14*c* with the contacting portions 81 extending into the second receiving space for electrically contacting with the second electronic card 4. The holes 24 of the shielding cover 2 provide spaces for the contacting portions 81 being biased thereinto when the contacting portions 81 and the second electronic card 4 are contacted. The soldering portions 85 of the second contact terminals 8 are bent downward to be soldered onto the printed circuit board (not shown). As described above, the soldering portions 75, 75' and 85 of the back row and the front row of the first contact terminals 7, 7', and the second contact terminals 8 are all located at the same rear of the card connector 100 for facilitating being soldered onto the printed circuit board (not shown).

Referring to FIG. 2, according to the present invention, a detection mechanism is disposed in the receiving room 17 of the insulation member 1 to detect the second electronic card 4. The detection mechanism comprises a detection spring 17*a* and a detection contact 17*b*. The second electronic card is detected when the detection spring 17*a* is elastically contacted with the detection contact 17*b*.

In the present invention, the rear contacting portions 71 of the back row of the first contact terminals 7 are aligned with the front contacting portions 71' of the front row of the first contact terminals 7', so the contacting portions 71 and 71' can be easily aligned and entirely contact with the contact pads of the first electronic card 3 to ensure an electrical contact there-between.

While the invention has been described by way of an example and in terms of a preferred embodiment, it is to be understood that the invention is not limited to the disclosed embodiment. To the contrary, it is intended to cover various modifications. Therefore, the scope of the appended claims should be accorded the broadest interpretation so as to encompass all such modifications.

What is claimed is:

1. A card connector for receiving two different types of electronic cards simultaneously comprising:

an insulation member, a platform member being disposed in the insulation member to divide the insulation member into a first receiving space adapted to receive a first electronic card and a second receiving space adapted to receive a second electronic card;

a shielding cover for covering the insulation member;

a back row of spaced first contact terminals received in the insulation member, each of the back row of the first contact terminals comprising a rear contacting portion, a rear connecting portion and a rear soldering portion, the rear contacting portion extending into the first receiving space to contact with the first electronic card, the rear connecting portion connecting the rear contacting portion and the rear soldering portion, the rear soldering portion extending outwardly from a rear of the insulation member;

a front row of spaced first contact terminals received in the insulation member, each of the front row of the first contact terminals comprising a front contacting portion, a bent portion, a front connecting portion and a front soldering portion, the front contacting portion extending into the first receiving space to contact with the first electronic card and being aligned and flush with the rear contacting portion, the bent portion connecting the front contacting portion and the front connecting portion and offsetting the front connecting portion a predetermined distance from the front contacting portion, the front connecting portion connecting the bent portion and the front soldering portion, the front soldering portion extending outwardly from the rear of the insulation member; and a row of spaced second contact terminals received in the insulation member, each second contact terminal comprising a contacting portion, a connecting portion and a soldering portion, the contacting portion extending into the second receiving space to contact with the second electronic card, the connecting portion connecting the contacting portion and the soldering portion, the soldering portion extending outwardly from the rear of the insulation member.

2. The card connector as claimed in claim 1, wherein bottom edges of said platform members extend inwardly to form brims respectively.

3. The card connector as claimed in claim 1, wherein said insulation member has a top wall, two lateral walls and a rear wall extending downwardly from two lateral sides and a rear side of the top wall, said shielding cover has a baseboard, and two lateral boards extending upwardly from opposite sides of the baseboard.

4. The card connector as claimed in claim 3, wherein a back row and a front row of first terminal passages are defined in the top wall and run through the rear wall to receive the back row and the front row of the first contact terminals respectively.

5. The card connector as claimed in claim 3, wherein a row of second terminal passages is defined in the rear wall to receive the spaced second contact terminals.

6. The card connector as claimed in claim 3, wherein a row of holes is defined in the baseboard of the shielding cover.

7. The card connector as claimed in claim 3, wherein a first U-shaped indentation is defined in the front end of the top wall, and a second U-shaped indentation is defined in the front end of the baseboard aligning with the first U-shaped indentation.

8. The card connector as claimed in claim 1, wherein said first electronic card is a SIM card.

9. The card connector as claimed in claim 1, wherein a detection mechanism comprising a detection spring and a detection contact is disposed in the insulation member.

* * * * *